US008157008B2

(12) United States Patent
Lilley

(10) Patent No.: US 8,157,008 B2
(45) Date of Patent: Apr. 17, 2012

(54) CEMENT EVALUATION METHOD AND TOOL

(75) Inventor: Ian James Lilley, Silsoe (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 279 days.

(21) Appl. No.: 12/445,721

(22) PCT Filed: Oct. 17, 2007

(86) PCT No.: PCT/GB2007/003946

§ 371 (c)(1),
(2), (4) Date: Jul. 2, 2009

(87) PCT Pub. No.: WO2008/047107

PCT Pub. Date: Apr. 24, 2008

(65) Prior Publication Data

US 2010/0126718 A1 May 27, 2010

(30) Foreign Application Priority Data

Oct. 18, 2006 (GB) ..... 0620672.6

(51) Int. Cl.
*E21B 47/00* (2012.01)

(52) U.S. Cl. ..... 166/253.1; 166/311; 166/177.4

(58) Field of Classification Search ..... 166/253.1, 166/285, 170, 177.1, 177.3, 177.4, 250.14, 166/311, 66, 222
See application file for complete search history.

(56) References Cited

U.S. PATENT DOCUMENTS

| | | | | |
|---|---|---|---|---|
| 2,451,472 | A | 10/1948 | Coggeshall | |
| 3,213,414 | A | 10/1965 | Moser | |
| 4,685,092 | A * | 8/1987 | Dumont | 367/35 |
| 6,460,617 | B1 * | 10/2002 | Allen | 166/173 |
| 6,741,185 | B2 * | 5/2004 | Shi et al. | 340/853.2 |

FOREIGN PATENT DOCUMENTS

| | | |
|---|---|---|
| GB | 2 101 703 A | 1/1983 |
| WO | 99/10624 A | 3/1999 |

OTHER PUBLICATIONS

International Search Report for PCT/GB2007/003946 mailed Jan. 30, 2008 (3 pages).

* cited by examiner

*Primary Examiner* — David Bagnell
*Assistant Examiner* — Jacob Hall
(74) *Attorney, Agent, or Firm* — Osha Liang LLP

(57) ABSTRACT

A method of preparing a wellbore for production includes running a wellbore clean-out string, including a cement evaluation tool and a wellbore cleaning tool, into a wellbore, acquiring data relating to at least one property of a cement bond of the wellbore, using the cement evaluation tool, and simultaneously cleaning the wellbore, using the wellbore cleaning tool, as the clean-out string is run into the wellbore in order to acquire first and second sets of data while running the string into the wellbore. The first and second sets are combined to form first and second logs of cement bond, which are used to produce an enhanced log of the cement bond.

19 Claims, 4 Drawing Sheets

CEMENT EVALUATION METHOD AND TOOL

FIELD OF THE DISCLOSURE

The present invention relates to downhole tools, and in particular, but not exclusively, to cement evaluation tools for evaluating a condition of cement in cased or lined portions of wellbores.

BACKGROUND

Downhole tools have long been used for performing various operations in wellbores. Such tools are regularly used in the oil and gas industry in various stages from drilling a well to its completion ready for production of hydrocarbons from a sub-surface reservoir.

There are a number of stages involved in forming and preparing a well for hydrocarbon production. These stages include the deployment of different types of tool or tubing strings, which typically comprise a number of tubular sections or pipe sections joined together. Various downhole tools may be mounted to or incorporated into such strings.

The first stage in obtaining hydrocarbons from a well is a drilling stage, where a drill string is used with a cutting drill bit for penetrating into the earth.

After drilling, the wellbore is usually subjected to one or more casing stages. Casing involves locating a tubular lining in the wellbore such which prevents the wellbore walls collapsing; and provides a flow path for recovery of well fluids to surface.

The casing is secured in location by cement that is set in an annular space between the casing and the wellbore wall, the cement entering the borehole from near the bottom of the casing and passing up the annular space between the wellbore wall and the casing.

It is important that the cementation in the annular space provides a seal around the casing such that fluid cannot penetrate or flow through the cement in the annular space. Accordingly, when cementing, it is important to keep the casing central in the wellbore. Centralisation may be achieved by including casing centraliser tools in the casing string, as is known in the art.

Often there are several stages of drilling and casing. For example, it is usual to drill to a certain depth, case a portion of the wellbore, drill to a further depth and then case the next portion of the well, and so on in a successive fashion until the well is drilled and cased to the required depth.

Once the drilling is completed and the wellbore cased, the wellbore is then cleaned and prepared for completion.

This is carried out by running clean-out strings, which can include combinations of tools for cleaning or polishing interior surfaces of the casing, to remove debris and junk from the well. For example, scrapers, brushes, wipers, and/or fluid jetting tools are often incorporated in a clean-out string.

After the clean-out operation, it is usual to conduct various logging operations. In these operations, properties of the wellbore are measured and logged using wellbore logging tools. These wellbore logging tools are typically suspended in the wellbore on one end of a line connected to a spool at the surface, and may be suspended on a wireline which includes direct power and data communication lines to the surface. Actual measurement is carried out on extraction of the logging tools when the line is in tension, rather than during insertion, because it gives the operator control of the tool, allows it to be extracted at a steady speed and assists in keeping the logging tools central in the wellbore.

Cement evaluation tools are used to log data concerning the quality of the cement and thus of the cement bond in the cased portions of the wellbore. It is important to run these tools to check for any defective regions of the cement, where, for example, cracks and conduits may be located providing alternative fluid paths in which hydrocarbons can flow. Such paths can cause hydrocarbons to be lost from the reservoir and can be detrimental to the control and effective recovery of hydrocarbons from the well.

Once the cement bond has been checked and is considered to be of sufficient quality, the next stage is to run a production string into the well, which provides completion equipment for extracting well fluids.

It is clear that each of these operational stages combine to give rise to significant expense associated with the drilling and completion of a well. A particular problem is that cement bond logging tools are run independently taking up large amounts of rig time. For example, a typical cement evaluation log carried out over a 100-meter casing section takes between 12 to 24 hours to complete, and can involve around ½ million dollars of rig time. Thus, cement logging performed as an independent operation is costly.

It is an object of the present invention to obviate or at least mitigate some of the drawbacks and deficiencies of existing tools and methods.

Other aims and objects of the invention will become apparent from the description below.

SUMMARY OF THE DISCLOSURE

According to a first aspect of the invention, there is provided a method of obtaining a wellbore cement bond log comprising the steps of:

- running a cement evaluation tool into a wellbore on a drill pipe or tubing string;
- acquiring data relating to at least one property of a cement bond of the wellbore using the cement evaluation tool; and
- generating a log of the acquired data.

The present invention enables cleaning and cement bond evaluation to be carried out in a single wellbore run.

The cement evaluation tool and the wellbore cleaning tool may be coupled together. The cement evaluation tool and the wellbore cleaning tool may be located on a tubing which may be a drill string or other tubing string, such as a wellbore clean-out string. Alternatively, the cement evaluation tool and the wellbore cleaning tool may, be located on a wireline or slickline.

The method may be a method of cleaning a wellbore and producing a wellbore cement bond log, and may comprise the step of cleaning the wellbore using the wellbore cleaning tool. In this way, cement evaluation and wellbore cleaning can be carried out in a single wellbore run.

The step of cleaning the wellbore and acquiring data may be performed simultaneously. Alternatively, the step of cleaning the wellbore may be performed before the step of acquiring data. In a further alternative, the step of acquiring data may be performed before the step of cleaning the wellbore. However, it will be understood that cleaning and data acquisition can take place at any time during which the wellbore cleaning tool and the cement evaluation tool are located in the wellbore together.

The method may comprise the step of running a wellbore clean-out string, comprising the cement evaluation tool and the wellbore cleaning tool, into the wellbore.

The step of acquiring data may be performed during the run-in and/or pull out of the cement evaluation tool and the cleaning tool.

The method may include the step of running cementation equipment into the wellbore on a tubing string.

Optionally, the method includes the step of performing cementation of wellbore lining tubing, which may comprise a casing and/or liner. This may enable cementation and cement bond evaluation to be carried out in a single wellbore run, i.e. without extracting the tubular string from the wellbore.

Accordingly, a log of cement bond data may be generated whilst cementation operations are performed in the wellbore and/or after cementation and thus in the same run in which cementation operations take place.

The step of acquiring data may include the steps of:

transmitting a sonic signal to the cement bond; and receiving a reflected sonic signal scattered by the cement bond.

Additionally, the step of acquiring data may include the steps of:

transmitting a sonic signal to the cement bond; and receiving a reflected sonic signal scattered from an interface between the cement bond and another wellbore medium. This may be, for example, an interface between the cement bond and a wellbore rock formation.

Alternatively or in addition, the step of acquiring data may include the steps of:

transmitting a sonic signal to the cement bond; and receiving a reflected sonic signal scattered from a defect in the cement bond. Such a defect may be a fracture or void in the cement bond. This advantageously allows cement bond defects to be located.

The step of acquiring data may include the steps of:

acquiring a first set of data while running the string into the wellbore; and acquiring a second set of data while pulling the string out of the wellbore.

In this way, the number of data sets obtained is increased. The first and second data sets may be merged with each other giving rise to advantages including an improved signal-to-noise ratio and improved accuracy.

The step of acquiring data may further include the steps of:

using the first and second data sets to form corresponding first and second logs of the cement bond; and combining the first and second logs to produce an enhanced log of the cement bond.

The enhanced log may reflect improved signal-to-noise characteristics of the data and may improve accuracy of the generated log.

The method may include the further step of acquiring wellbore environmental data. The step of acquiring wellbore environmental data may include one or more additional steps selected from a group comprising:

measuring temperature;

measuring pressure between an outer surface of the tubular string and an inner wall of the wellbore;

measuring pressure inside the tubular string; and measuring gamma ray radiation.

This data may provide supplementary information concerning the wellbore, which advantageously assists in the interpretation of the wellbore cement bond log.

The method may comprise running the cement evaluation and cleaning tools on a tubing string, and may include the further step of acquiring data relating to the tubing string. The step of acquiring data relating to the tubing string may comprise measuring strain in the tubing string via a strain gauge. Alternatively or additionally, the step of acquiring string data may include measuring vibration via an accelerometer. This data may provide supplementary information concerning the string, which may assist in the interpretation of the wellbore cement bond log, and which may also provide an indication of performance and suitability of the string used.

Preferably, the method includes the further step of transmitting data to a remote location. Thus, the method may comprise the step of transmitting data relating to at least one property of a cement bond; the tubing string; and/or wellbore environmental data to a remote location.

Preferably also, the method includes the further step of processing data. The method may comprise the step of processing data relating to at least one property of a cement bond; the tubing string; and/or wellbore environmental data.

The method may include the step of correlating the cement bond log with depth. This may facilitate determination of-the depth location of each measurement point and any anomalies in the data. In turn, this may facilitate the location of defects or faults in the cement bond to be determined.

Preferably, the method includes the step of using the cement bond log to determine a condition of the cement bond.

According to a second aspect of the invention there is provided a method of preparing a wellbore for production, including the step of cleaning a wellbore and obtaining a cement bond log in a single wellbore run.

In the preparation of a wellbore for production following the method of the present invention, the wellbore may be cleaned and the cement bond may be logged in a single run and thus without extracting a tubing string or wireline, on which cleaning and logging and/or cement evaluation tools are run, from the wellbore. Cleaning of the wellbore may be carried out before, after and/or simultaneously with acquiring data for the cement bond log. Accordingly, the data may be partially acquired while cleaning is in progress, and may be partially acquired before and/or after cleaning of the wellbore.

For example, in a single wellbore run, the following time-sequence for performing operations is made possible:

1) cement bond data acquisition alone;

2) cleaning and cement bond acquisition together;

3) cleaning alone.

According to a third aspect of the invention, there is provided a wellbore cement bond logging assembly, the assembly comprising:

a cement evaluation tool adapted to acquire data relating to at least one property of a cement bond of a wellbore, to facilitate generation of a log of the cement bond; and a wellbore cleaning tool.

The assembly may therefore be used to acquire cement bond data and to clean the wellbore in a single run. Cleaning and cement bond data acquisition may be carried out together or separately at any time during which the assembly is being run in the wellbore.

Preferably, the wellbore cleaning tool and the cement evaluation tool are adapted to be incorporated in a tubing string, such as a wellbore clean-out string. The wellbore cleaning tool and the cement evaluation tool may be coupled together or may be spaced by one or more tubing sections such as a tool sub.

The wellbore cleaning tool may include one or more tools selected from the group comprising: stabilisers, fluid circulation tools, fluid filtering tools, junk removal tools, wipers, magnetic cleaning tools, brushes, and/or scrapers.

The assembly may include wellbore cementation equipment. Optionally, the tubing string may be a cementation string including the cementation equipment. The assembly may therefore be used to perform cementation of casing and to acquire data relating to the cement bond log in a single wellbore run.

Data may be acquired while running the string into and/or pulling the string out of the wellbore. This may facilitate acquisition of at least two data sets from a particular portion of the wellbore, which can be combined into an enhanced data set to improve signal to noise characteristics or other characteristics, e.g., accuracy of depth correlation estimates or other data accuracy.

Preferably, the cement evaluation tool comprises at least one sonic tool. The sonic tool may include at least one acoustic transmitter adapted to provide a sonic signal to a cement bond and at least one receiver. The cement and casing can therefore be probed using the sonic tools to provide data allowing the condition of the cement and the casing to be evaluated. Optionally, the assembly comprises a first and second sub. The first sub may include the sonic tool, and the second sub may include the wellbore cleaning tool. In this way, the cleaning tool and the sonic tool may be provided together, as a compact unit. This allows the cleaning tool and the sonic tool to be rapidly connected in the tubing string as required and at one location, if desired.

The first and second subs may be coupled and may be directly coupled together, or coupled via an intermediate sub, which may include additional wellbore tools or devices. It will therefore be understood that the cement evaluation tool may be a modular tool allowing subs fitted with different tools or equipment to be interchanged.

Preferably, the assembly comprises at least one device selected from the group comprising:

- a temperature sensor for measuring ambient temperature data in the wellbore;
- a pressure sensor for measuring pressure inside the tubing string;
- a pressure sensor for measuring pressure in an annular space between the wellbore wall and the tubing string;
- a strain gauge for use in acquiring strain data;
- an accelerometer for use in acquiring vibration data; and
- a casing collar locator tool and/or a gamma ray tool for depth correlation.

Accordingly, information concerning the wellbore environment and the tubing string may be acquired, which may assist in interpreting the cement bond data and/or the corresponding log. The device may be located on any one of the first, second or intermediate subs.

The provision of a casing collar locator and/or gamma ray tool may allow the depth corresponding to each measurement point of the data relating to the cement bond to be determined, thereby enabling the location of defects or faults in the cement bond.

Preferably, the assembly further includes a data transmission system for transmitting data obtained by the assembly to a remote location. The data transmission system may be a mud-pulse telemetry system or an electromagnetic (EM) transmission system.

The assembly may include a data storage unit. The data storage unit may comprise a remote computer located at the surface or may be a local memory unit incorporated in the cement evaluation tool. This may allow data to be stored for subsequent processing and manipulation into a suitable form for interpretation.

According to a fourth aspect of the present invention, there is provided a method of cleaning a tubing lined wellbore and of evaluating cement located around the tubing, the method comprising the steps of:

- running an assembly comprising a cement evaluation tool and at least one cleaning element into the wellbore tubing;
- activating the cement evaluation tool to evaluate the cement; and
- cleaning the tubing using the at least one cleaning element.

According to a fifth aspect of the present invention, there is provided a wellbore cleaning and cement evaluation assembly for use in cleaning a tubing lined wellbore and evaluating cement located around the tubing, the assembly comprising:

- a cement evaluation tool for evaluating the cement; and
- at least one cleaning element for cleaning the tubing.

Further features of these aspects of the invention may be in accordance with the first and/or second; or third aspects defined above.

According to a sixth aspect of the invention, there is provided a method of obtaining a wellbore cement bond log comprising the steps of:

- running a cement evaluation tool into a wellbore on a tubing string;
- acquiring data relating to at least one property of a cement bond of the wellbore using the cement evaluation tool; and
- generating a log of the acquired data.

In this way, data relating to a cement bond of a wellbore can be obtained by running a cement evaluation tool on a tubing string. This may enable a number of downhole operations to be carried out, whilst the string is in the wellbore, for example, by coupling further tools or assemblies to the tubing string. As is known in the art, the cement bond of a wellbore is the cement set in the annular space between an outer surface of a casing or liner string and an inner surface of the wellbore wall and/or an outer, larger diameter casing.

The tubing string may be a string of tubing sections coupled together, and may be a cementation string for performing cement jobs in a wellbore. In a preferred embodiment, the tubing string may be a wellbore cleanout string for performing cleaning operations in a wellbore.

Preferably, the method includes the step of running a wellbore cleaning tool or cleaning elements into the wellbore on the string. Advantageously, this enables cleaning and cement bond evaluation to be carried out in a single wellbore run. That is, a cleaning tool or element located on the string can perform cleaning operations in the well, and the cement bond evaluation tool located on the same string may carry out measurements for cement bond evaluation, without extraction of the string from the wellbore.

Other features of this aspect of the invention may be in accordance with the first and/or fourth aspects of the invention.

According to a seventh aspect of the invention, there is provided a wellbore cement bond logging assembly comprising:

- a tubing string and a cement evaluation tool coupled to the tubing string for acquiring data relating to at least one property of a cement bond of the wellbore, to facilitate generation of a log of the cement bond.

The at least one property of the cement bond may include physical properties of the cement bond, for example, density and/or thickness. The properties may comprise acoustic impedance properties of the cement bond.

In this way, the assembly can advantageously be used to evaluate the quality of the wellbore cement bond while running a string, which may carry one or more other tools or devices.

The assembly may include a wellbore cleaning tool.

Other characteristics of the assembly may be in accordance with the third and/or fifth aspects of the invention.

BRIEF DESCRIPTION OF THE DRAWINGS

There will now be described, by way of example only, embodiments of the present invention, with reference to the accompanying drawings, in which.

DETAILED DESCRIPTION

Figure 1:
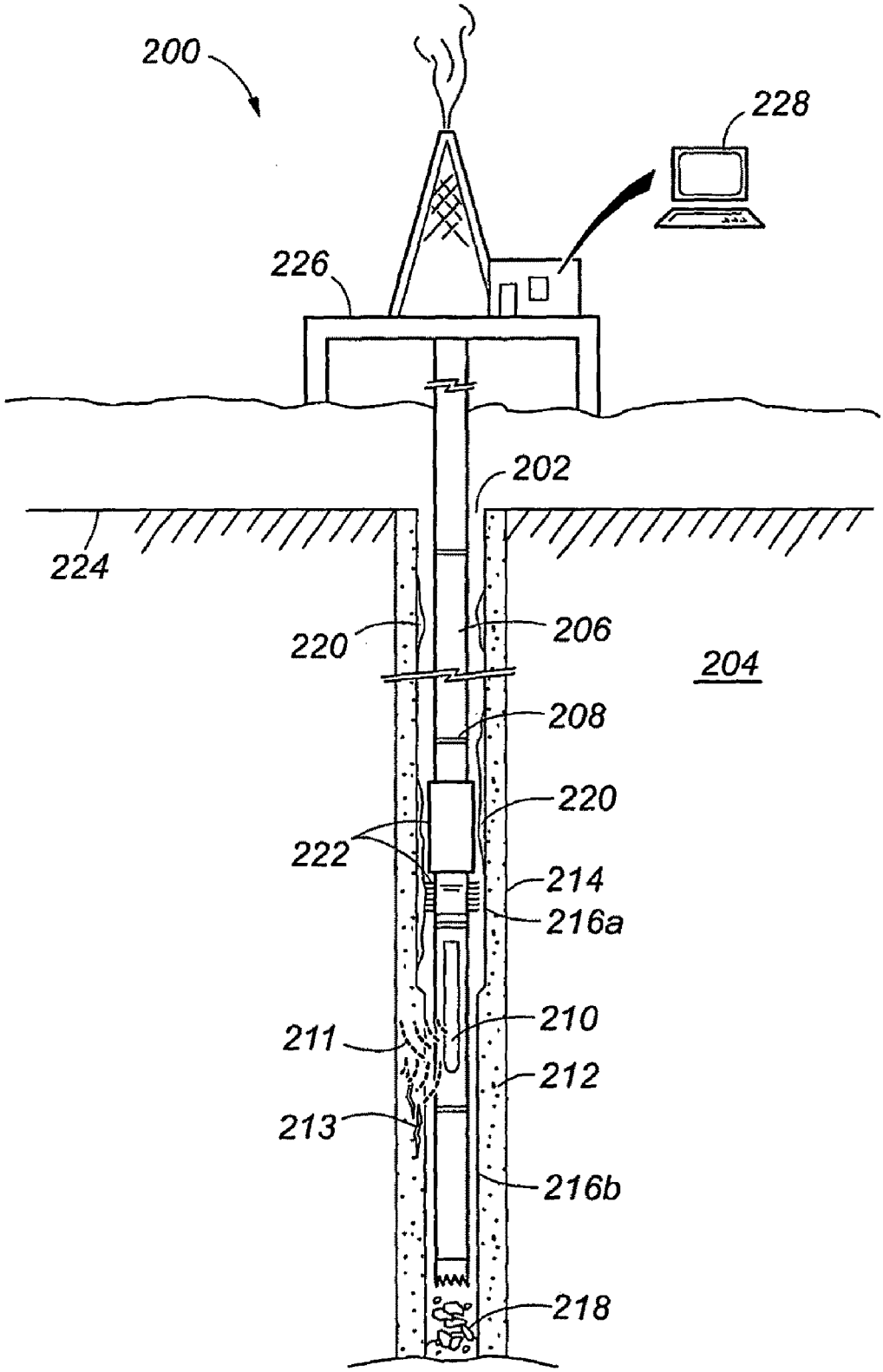
FIG. 1 is a schematic cross-sectional view illustrating a method of producing a cement bond log while cleaning a wellbore, and a corresponding assembly, in accordance with an embodiment of the invention.

With reference firstly to FIG. 1, there is depicted generally at reference numeral 200 a tubing string in operation in a clean-out stage of wellbore operations, incorporating a cement bond logging assembly in accordance with an embodiment of the invention. A wellbore 202 is provided with casing 216*a, b* in upper and lower portions of the borehole, respectively. The casing 216*a,b* is secured in place by a cement bond 212 comprising cement that has been injected in the region between a wall 214 of the wellbore 202 and the casing 216*a,b*. Various pieces of debris and junk 218 are present in the wellbore 202, and on interior surfaces of the casing 216*a,b* there are various residue materials 220 present.

The string 200 comprises a number of tubular sections 206 joined together end-to-end at 208, as shown in the Figure. Cleaning tools 222 are located on the string 200 for removing the residues 220 and the debris and junk 218. In addition, a cement evaluation tool 210 is incorporated into the string 200 for measuring and logging properties of the cement bond 212. This enables logging of the cement bond to be carried out while cleaning the wellbore, and during entry and exit of the string from the wellbore, if desired.

The properties logged may be, for example, physical properties such as density or thickness of the cement bond 212. Alternatively, acoustic or sonic properties may be measured, such as acoustic amplitudes or acoustic impedance. Alternatively, properties such as wave incidence angles might be logged. In FIG. 1, cracks, defects, or channels 213 in the cement formation 212 can be probed using the tool 210. In this case, a sonic signal 211 is transmitted into the cement formation 212 and the reflected signal is detected by a receiver (not shown in FIG. 1). Differences or contrasts in acoustic impedance associated with a crack 213 may result in variations in propagation of the acoustic signal and, in turn, the acoustic or sonic data acquired and logged, such that location of problematic regions of the cement can be identified from the logged data.

In this embodiment, the cement evaluation tool 210 is provided with a transmission system (not shown in FIG. 1) for transmitting logged cement evaluation data to a computer 228 located remotely from the well on an offshore platform or rig 226. This computer 228 is used to perform processing of the data acquired and logged by the evaluation tool. The transmission system can be a mud-pulse or EM telemetry system or other tool-to-surface transmission system, such as an EM transmission system, which may operate by inductively transmitting a signal through the tubular pipe string.

The transmission system may include a separate inductive coupler tool, for example, as a back-up if the EM or mud-pulse telemetry system fails during operation. In this case, the inductive coupler tool is run on a wireline together with the tubular string fitted with the cement evaluation tool. The inductive coupler may be configured to measure field effects produced by joints and collars of downhole tubing. This information is conveyed to the surface via the wireline for depth determination. Data may then be stored locally and retrieved once the string is pulled from the well.

Figure 2:
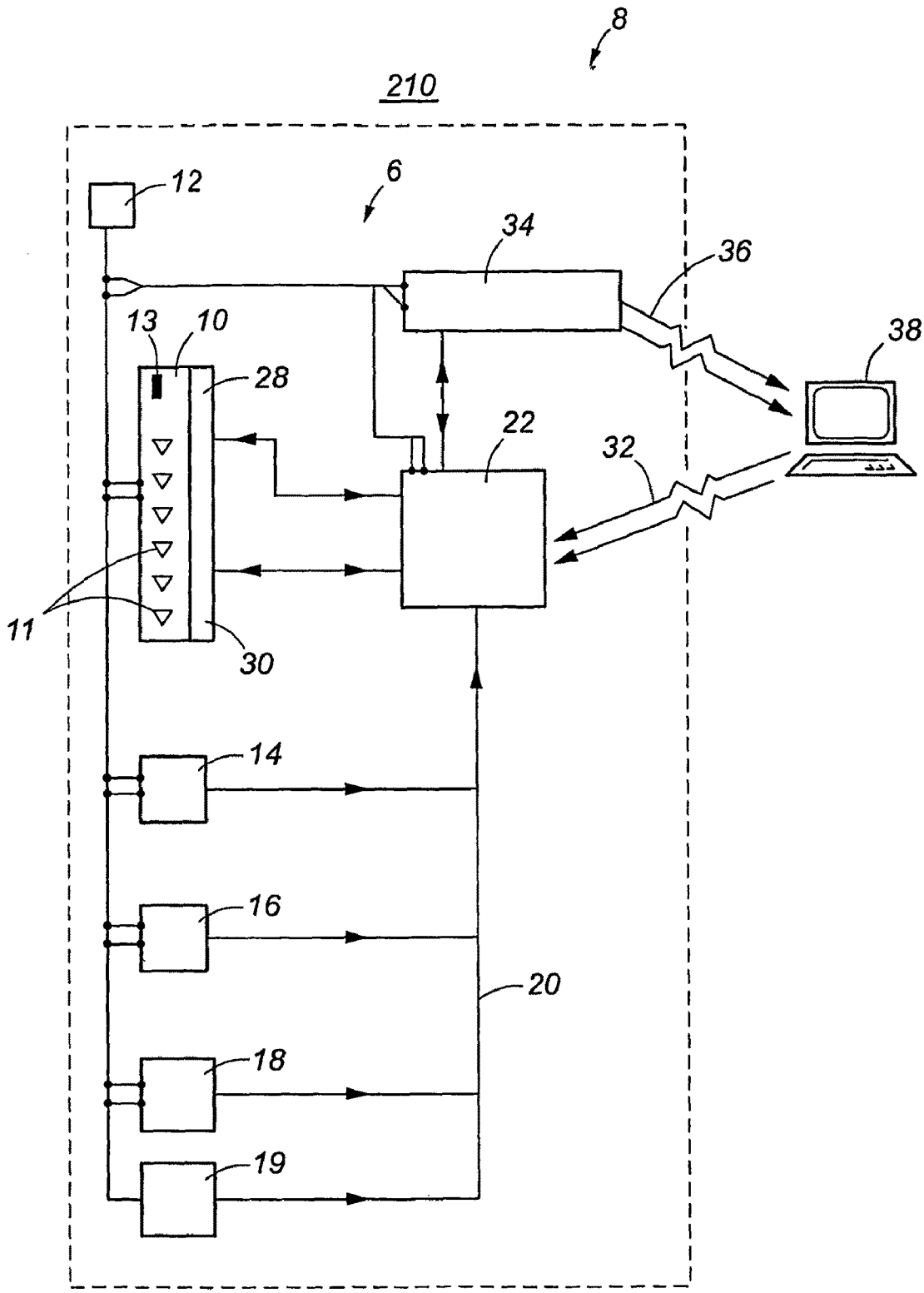
FIG. 2 is a schematic circuit diagram of a cement evaluation tool forming part of the assembly shown in FIG. 1.

In FIG. 2, there is depicted at 8 a circuit diagram of a cement evaluation tool forming part of the tool 210 of FIG. 1. The tool 210 comprises a number of elements all powered via a power source 12. The evaluation tool 210 also comprises a sonic tool 10 which can probe the cement formation located between the casing and the earth formations in a cased portion of a borehole. The tool 10 includes receivers 11, and a transmitter 13 for transmitting an acoustic or sonic signal and receiving reflected energy from the cement. A received signal will vary according to density, acoustic impedance contrasts and other characteristics of the cement formation. These physical characteristics provide information diagnostic of the condition of the cement.

The sonic tool 10 further includes a control unit 28 and a memory unit 30. Acoustic data obtained from the sonic tool 10 may be stored in the memory unit 30. The control unit 28 includes circuitry that controls the acquisition of data. Both the storage unit 30 and control unit 28 are connected to a central data control unit 22. The central data control unit 22 receives instructions from a remote computer 38, and also manages data acquired from supplementary sub-tools and sensors of the cement evaluation tool 210.

The cement evaluation tool 210 additionally comprises a gamma ray device 14, which is adapted to take measurements of natural radiation of the earth formation during operation of the tool 210. The data derived from the gamma ray device is used for the purpose of depth correlation, for example, by comparing the gamma ray data with existing well logs to identify the depth location of the cement evaluation tool 210.

In addition, the evaluation tool 210 includes a casing collar locator device 16, which is also used for depth correlation. Specifically, this device 16 is configured to identify areas of the casing of increased thickness, such as a casing collar where adjacent sections of casing meet. Having located the depth of the collar, the depth of the tool 210 can be determined. The evaluation tool 210 is also outfitted with an environmental measurement device 19, comprising a temperature sensor, a pressure sensor, a strain gauge and a 3-axis accelerometer.

In use of the cement evaluation tool 210, the data obtained is fed electronically via a line 20 to the central data control unit 22. This control unit 22 is connected to a transmission unit 34 which transmits the data 36 to the remote computer 38 for processing. The transmission unit 34 typically takes the form of an electromagnetic (EM) transmission unit, but in other embodiments, may be a mud-pulse telemetry transmission unit. The processed data provides a cement log together with corresponding depth and environmental information, which can be used to aid interpretation of the cement log.

Figure 3:
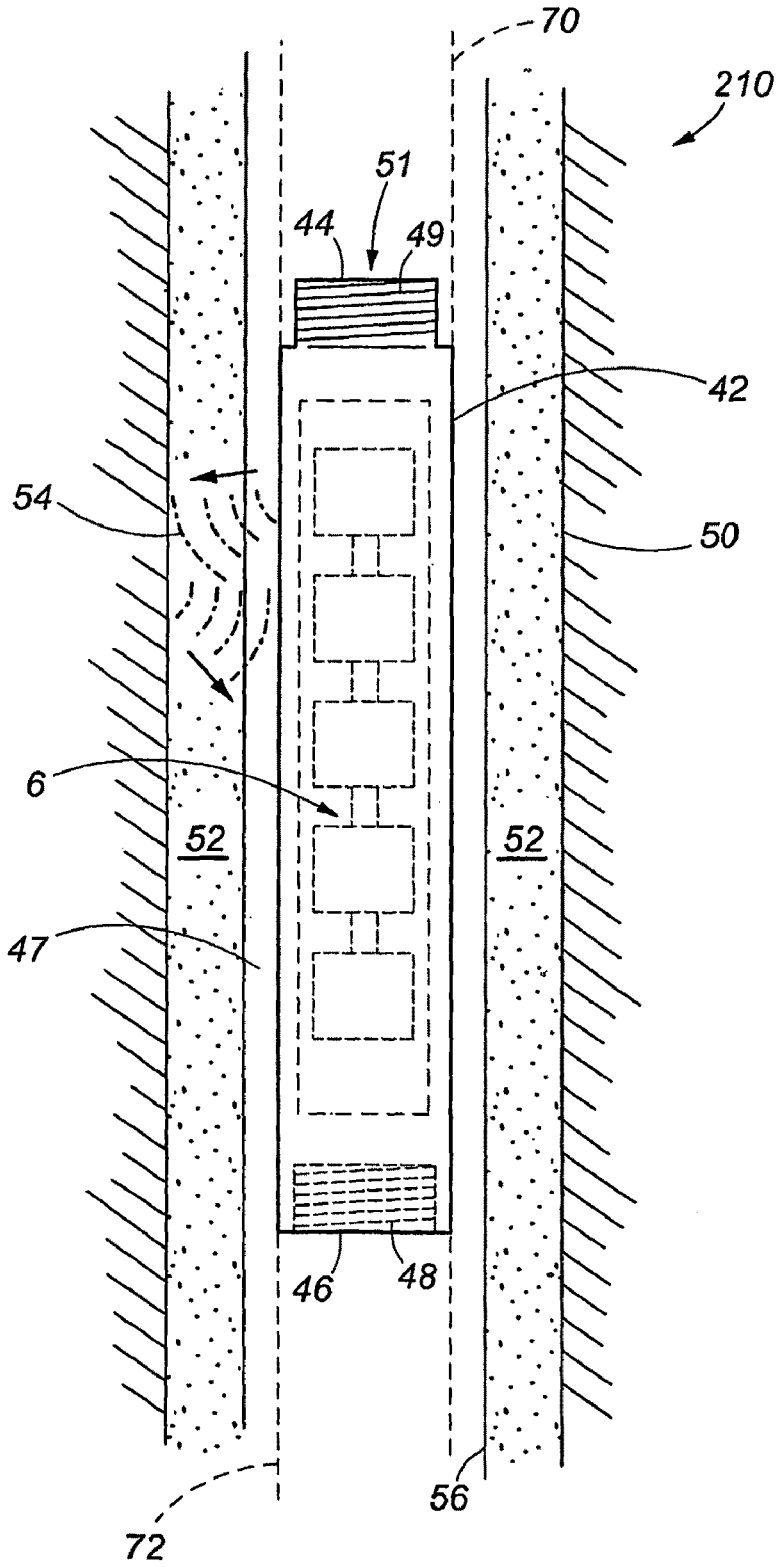
FIG. 3 is a schematic view of the cement evaluation tool shown in FIG. 1.

The above cement evaluation tool, devices and components are configured for downhole use and for integration into a cylindrical body or pipe segment for inserting into a tubular string as depicted in outline in FIG. 3.

In FIG. 3, the tool 210 is shown located and configured for use in the wellbore 202. The tool 210 comprises a cylindrical body 42 with a group of components 6 of the tool 210, illustrated schematically at 8 in FIG. 2, installed. At a first end of the body 42 there is located a male connecting portion or pin section 44 and at a second end a female connecting portion or box section 46. These sections 46 and 44 are provided with threads 48, 49 for engaging with adjacent pipe segments 70, 72 or other adjacent tubular tool bodies.

In this embodiment, the tool 210 is configured to provide sonic energy, indicated at 54, to the cement bond 52 between the casing 56 and earth formations of the wellbore wall 50. Pressure sensors of the environmental tool 19 can sense pressure-in the cylindrical space 51 of the tool and in the annular space 47 between the tool and the casing 56.

Figure 4:
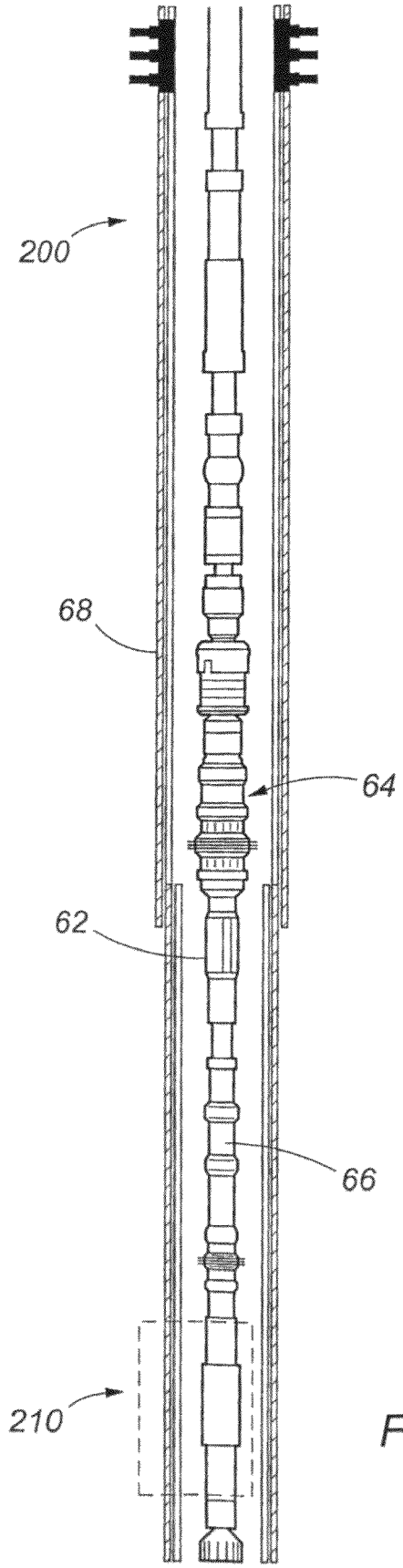
FIG. 4 is a detailed view of a cement bond logging assembly in accordance with an alternative embodiment of the invention.

With further reference to FIG. 4, the evaluation tool 210 is shown incorporated into a well clean-up string 200. This string 200 includes a number of cleaning components, including a mill tool 62, a magnetic cleaning tool [beta] [beta] and a clean-up tool 64 having brushes and/or wipers located above the cement evaluation tool 210 in the clean-up string 200. Other tools, such as a top-dress mill, a circulation or jetting tool, or tools for preparing a polished bore receptacle (PBR) may also be included in the string 200.

It should be understood that the cement log may be carried out using any type of tool suitable for the purpose of providing information on the condition of the cement. In particular, the above-described example of a sonic transmitter-receiver arrangement for probing the cement should not be considered restrictive of the scope of invention.

In use, the cement evaluation tool 210 is inserted into the tubing string 200, for example, by locating the connecting sections of the tool body into complementary sections of adjacent tubing sections at the required position in the string. The cleaning tools 62, 64 and 66 are inserted in a similar manner to the cement evaluation tool 210. These may be placed above or below the cement evaluation tool 210. Well fluids pass up through the tubular body of the cement evaluation tool.

The string 200 is then run-in to the wellbore 202, carrying the cleaning tools and the cement evaluation tool. During insertion of the string, the tool logs data concerning the cement condition, while the cleaning tools remove residues and/or wash and polish interior surfaces of the casing 216. Junk and other materials may also be removed using different tools. The data acquired may be acoustic data relating to a property such as density or acoustic impedance of the cement 212. This can be carried out using a sonic transmitter-receiver tool.

During operation, the tool 210 can store data locally as necessary and/or transmit acquired data back to the surface from where the string entered the well for monitoring or to conduct early processing of the data. A mud-telemetry communication system or EM communication system could be employed to transmit the data.

Additional components of the tool are used to perform measurement of environmental properties, such as temperature, and pressure conditions. Tubing string strain and vibrations may also be measured via strain gauges and accelerometers, respectively. Data acquired from these components are also transmitted to the surface.

After the log and cleaning operations have been carried out, during the run-in of the string 200, the string is then run out of the wellbore 202. Further logging of cement bond data and cleaning may be performed during this extraction phase. This provides a log of cement data and cleaning from both the insertion and the extraction phases of running the string 200 in the wellbore 202.

Once the operation is completed, the logged data results are processed to provide a log of the cement data, providing an indication of the quality of the cement and cementation bond quality. As log data are acquired during extraction and insertion of the string, an enhanced quality cement log data may be formed with relatively well-suppressed noise characteristics.

The present method and tool provide various advantages. Principally, incorporation of the cement tool and clean-out tools on a single tubing string removes the need to carry out a clean-out operation and a cement bond logging operation separately. This saves significant costs in the drilling and completion of a well.

It should also be appreciated that the cement bond evaluation tool as described above may also be incorporated into a cementation string as used for cementing the casing in the wellbore. This enables the cement bond to be logged as part of the cementation operation.

Other improvements and modifications may be made to the foregoing without departing from the spirit and scope of the present invention. For example, other logging tools may be incorporated on the string as may other types of clean-up tools, in any combination.

The invention claimed is:

1. A method of preparing a wellbore for production, the method comprising the steps of:

running a wellbore clean-out string, including a cement evaluation tool and a wellbore cleaning tool, into a wellbore;

acquiring a first set of data relating to at least one property of a cement bond of the wellbore using the cement evaluation tool;

simultaneously cleaning the wellbore using the wellbore cleaning tool as the clean-out string is run into the wellbore in order to acquire the first set of data while running the string into the wellbore;

acquiring a second set of data relating to at least one property of a cement bond of the wellbore using the cement evaluation tool;

simultaneously cleaning the wellbore using the wellbore cleaning tool as the clean-out string is pulled out of the wellbore in order to acquire the second set of data while pulling the string out of the wellbore;

using the first and second data sets to form corresponding first and second logs of the cement bond; and combining the first and second logs to produce an enhanced log of the cement bond.

2. The method as claimed in claim 1, wherein the cement evaluation tool and the wellbore cleaning tool are coupled together.

3. The method as claimed in claim 1, wherein the method includes the step of running cementation equipment into the wellbore.

4. The method as claimed in claim 1, further comprising the step of performing cementation of a casing located in the wellbore.

5. The method as claimed in claim 1, wherein the step of acquiring data includes the steps of:

transmitting a sonic signal to the cement bond; and receiving a reflected sonic signal scattered by at least one of a group consisting of the cement bond, an interface between the cement bond and another wellbore medium and a defect in the cement bond.

6. The method as claimed in claim 1, further comprising the step of acquiring wellbore environmental data wherein the step of acquiring wellbore environmental data includes at least one step selected from a group consisting of:

measuring temperature;

measuring pressure between an outer surface of the tubular string and an inner wall of the wellbore;

measuring pressure inside the tubular string; and measuring gamma ray radiation.

7. The method as claimed in claim 1, further comprising the steps of running the cement evaluation and cleaning tools on a tubing string, and acquiring data relating to the string during running, wherein the step of acquiring data relating to the string comprises the step of measuring strain in the string or measuring string vibration.

8. The method as claimed in claim 1, further comprising the step of correlating the cement bond log with depth.

9. The method as claimed in claim 1, wherein the method includes the step of using the cement bond log to determine a condition of the cement bond.

10. A wellbore cement bond logging assembly comprising:

a combined cement evaluation tool and wellbore cleaning tool for installation on a wellbore clean-out string;

wherein the cement evaluation and wellbore cleaning tools are configured to simultaneously acquire data relating to at least one property of a cement bond of a wellbore, to facilitate generation of a log of the cement bond and to simultaneously clean the wellbore using the wellbore cleaning tool as the clean-out string is run into the wellbore in order to acquire a first set of data while running the string into the wellbore, wherein the cement evaluation and wellbore cleaning tools are configured to simultaneously acquire data relating to at least one property of a cement bond of the wellbore using the cement evaluation tool and simultaneously clean the wellbore using the wellbore cleaning tool as the clean-out string is pulled out of the wellbore in order to acquire a second set of data while pulling the string out of the wellbore, wherein the first and second data sets are configured to form corresponding first and second logs of the cement bond, and combine the first and second logs to produce an enhanced log of the cement bond.

11. The assembly as claimed in claim 10, wherein the wellbore cleaning tool and the cement evaluation tool are adapted to be incorporated in a tubing string.

12. The assembly as claimed in claim 10, wherein the wellbore cleaning tool includes at least one tool selected from a group consisting of: stabilisers, fluid circulation tools, fluid filtering tools, junk removal tools, wipers, magnetic cleaning tools, brushes, and scrapers.

13. The assembly as claimed in claim 10, wherein the assembly includes wellbore cementation equipment.

14. The assembly as claimed in claim 10, wherein the cement evaluation tool comprises a sonic tool.

15. The assembly as claimed in claim 14, wherein the sonic tool includes at least one acoustic transmitter configured to provide a sonic signal to a cement bond, and at least one receiver.

16. The assembly as claimed in claim 15, wherein the cement evaluation tool comprises a first and second sub, wherein the first sub includes the sonic tool, and the second sub includes the wellbore cleaning tool.

17. The assembly as claimed in claim 10, wherein the assembly comprises at least one device selected from a group consisting of:

a temperature sensor for measuring ambient temperature data in the wellbore;

a pressure sensor for measuring pressure data from inside the tubular string;

a pressure sensor for measuring pressure data in an annular space between the wellbore and the tubular string; a strain gauge for use in acquiring strain data;

an accelerometer for use in acquiring vibration data; and a casing collar locator tool; and a gamma ray tool for depth correlation.

18. The assembly as claimed in claim 10, wherein the assembly further includes a data transmission system for transmitting data to a remote location, wherein the data transmission system is one of a mud-pulse telemetry system or an electromagnetic (EM) transmission system.

19. The assembly as claimed in claim 10, wherein the assembly includes a data storage unit.

* * * * *